US011440071B2

(12) United States Patent
Bahlo

(10) Patent No.: US 11,440,071 B2
(45) Date of Patent: Sep. 13, 2022

(54) DEVICE FOR BENDING HOLLOW STRUCTURAL COMPONENTS

(71) Applicant: Ludwig Weber GmbH, Prisdorf (DE)

(72) Inventor: Jörg Bahlo, Schenefeld (DE)

(73) Assignee: Ludwig Weber GmbH, Prisdorf (DE)

( * ) Notice: Subject to any disclaimer, the term of this patent is extended or adjusted under 35 U.S.C. 154(b) by 0 days.

(21) Appl. No.: 15/929,566

(22) Filed: May 11, 2020

(65) Prior Publication Data

US 2020/0353524 A1 Nov. 12, 2020

(30) Foreign Application Priority Data

May 10, 2019 (DE) ..... 102019112251.1

(51) Int. Cl.
*B21D 9/03* (2006.01)

(52) U.S. Cl.
CPC ..... *B21D 9/03* (2013.01)

(58) Field of Classification Search
CPC ... B21D 9/03; B21D 9/01; B21D 9/00; B21D 9/12; B21D 9/125; B21D 9/05; B21D 9/07; B21D 9/073; B21D 9/076; B21D 39/14; B21D 41/26; B29C 67/0022; B29C 53/82; B29C 53/821; B21C 3/16; B21C 25/04; B21C 37/30
USPC ..... 72/466, 466.2, 283
See application file for complete search history.

(56) References Cited

U.S. PATENT DOCUMENTS

| | | | | |
|---|---|---|---|---|
| 3,315,516 | A * | 4/1967 | Sassak | B21D 9/03 72/466 |
| 4,123,930 | A | 11/1978 | Hill | |
| 4,475,375 | A * | 10/1984 | Hill | B21D 9/03 72/466 |
| 2004/0255638 | A1* | 12/2004 | Yogo | B21D 9/03 72/466.2 |
| 2008/0267698 | A1* | 10/2008 | Rinkenberger | B21D 9/00 403/301 |
| 2016/0175913 | A1* | 6/2016 | Tingley | B21D 9/01 29/416 |

FOREIGN PATENT DOCUMENTS

| | | | |
|---|---|---|---|
| CN | 101367099 | A | 2/2009 |
| CN | 101425097 | A | 5/2009 |
| CN | 104096733 | A * | 10/2014 |

(Continued)

OTHER PUBLICATIONS

Search report from European Patent Office dated Sep. 21, 2020 citing references provided with this IDS.

*Primary Examiner* — Teresa M Ekiert
(74) *Attorney, Agent, or Firm* — Michael J. Brown

(57) ABSTRACT

A device (10) is disclosed for bending hollow structural components (100), in particular pipes, having a mandrel shaft (40) for receiving a receiving element (20), wherein a row of at least two ball joints (30, 30') connected with each other can be inserted into the receiving element (20) at its end, wherein the row of ball joints (30, 30') is preferably lockable by a ball-and-socket joint (70) at an end located opposite the receiving element (20), wherein each ball joint (30, 30') of the row is circumferentially enclosed by a shingle (50, 50') and the ball-and-socket joint (70) is circumferentially enclosed by an end shingle (60) and the shingles (50, 60) overlap each other at least in portions.

8 Claims, 8 Drawing Sheets

(56) References Cited

FOREIGN PATENT DOCUMENTS

Figure 1B:
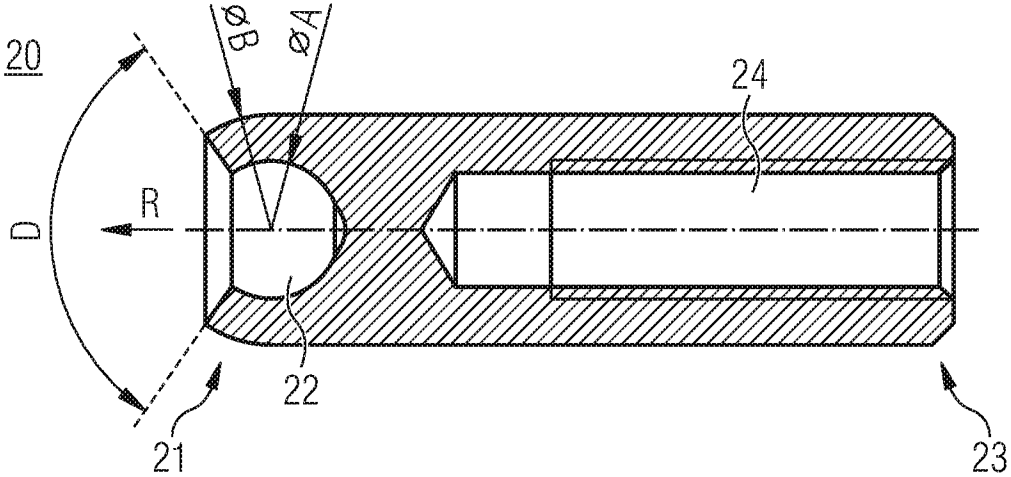

| | | | | | |
|---|---|---|---|---|---|
| FR | 2417351 | A1 | | 9/1979 | |
| FR | 2720015 | A1 | * | 11/1995 | ..... B21D 9/03 |
| GB | 700370 | | | 12/1953 | |

* cited by examiner

A-A

FIG. 2b B-B
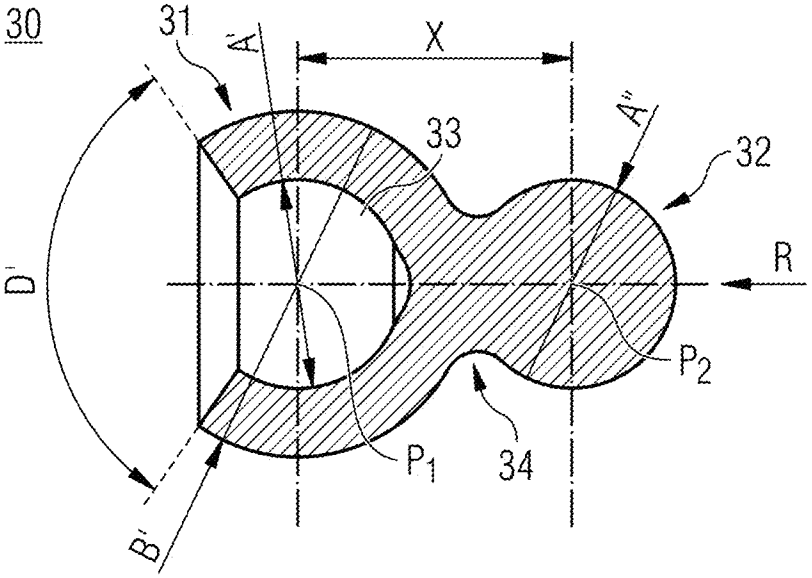
FIG. 2a
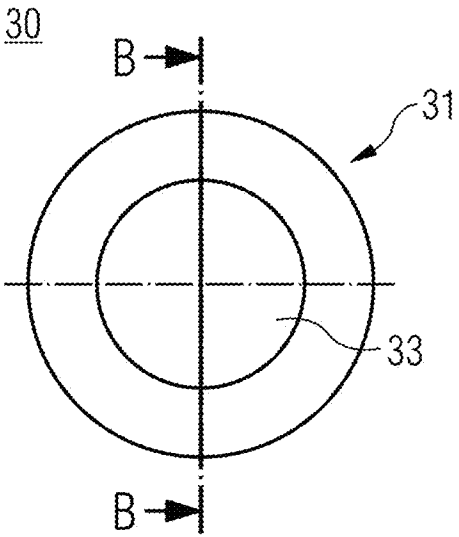
FIG. 2c
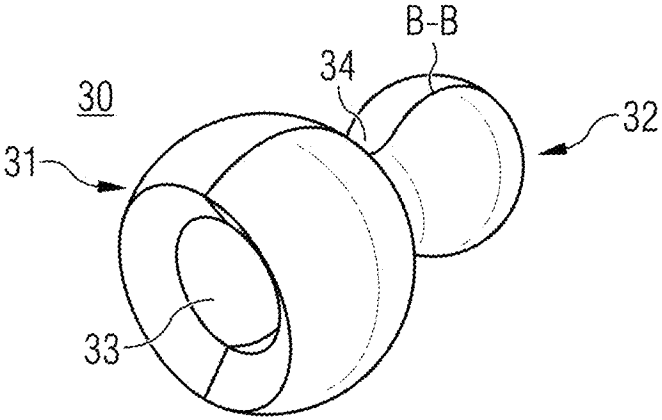

C-C

FIG. 4b D–D
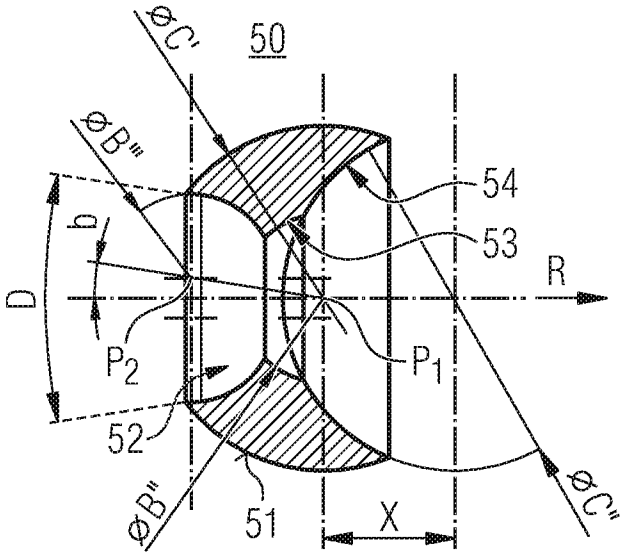
FIG. 4a
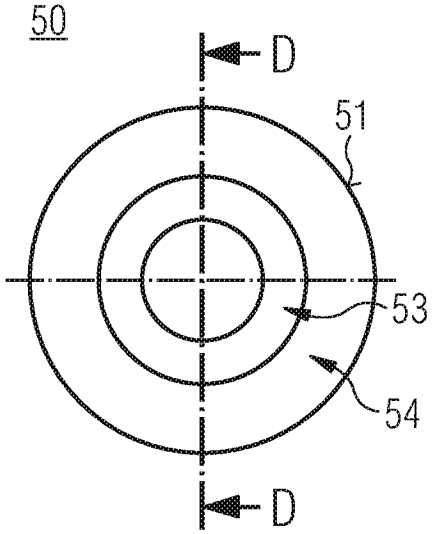
FIG. 4c
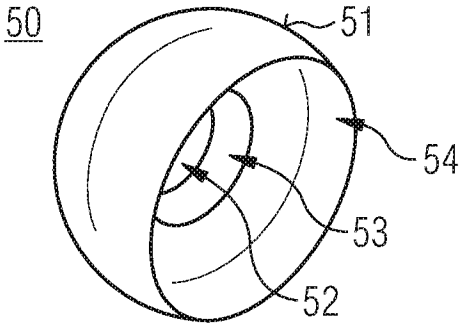

DEVICE FOR BENDING HOLLOW STRUCTURAL COMPONENTS

The invention refers to a device for bending hollow structural components, in particular pipes, having a mandrel shaft for receiving a receiving element, wherein a row of at least two ball joints connected with each other can be inserted into the receiving element at its end.

Various bending machines are already known which are used for bending metal pipes. Such bending machines can position a pipe by means of a clamping unit. A bending head may act on the pipe and can deform it directly or by means of a support form.

For ensuring a cross section of the pipe, usually a mandrel is inserted into the pipe before the bending process. For example, a shingle mandrel with a rope core is known which is adjusted in its length before it is used, in order to avoid a rattling or jamming of the shingles.

Additionally, shingle mandrels are known for being inserted into pipes which are configured as a chain with shingle members and have an invariable or fixed length. The respective shingle members are coupled to each other via hinges and can therefore be pivoted only along one direction of rotation.

Known bending mandrels are indicated in VDI 3430.

The shingle mandrels already known have relatively large vacuities between the respective shingles and the pipe to be bent, by which a continuous maintenance of the inner cross section of the pipe cannot be guaranteed.

It is the object of the invention to develop a device, for example a support mandrel, which enables a crease-free bending of hollow structural components with a minimal change of the cross section.

This task is solved by the features given in claim 1. Further advantageous embodiments of the invention are described in the sub-claims.

According to an aspect of the invention, a device for bending hollow structural components, in particular pipes, is provided. In particular, the device can be configured as a so-called joint shingle mandrel and can have a mandrel shaft for receiving a receiving element. A row of at least two ball joints connected with each other can be inserted into the receiving element at its end. The row of ball joints is preferably lockable by a ball-and-socket joint at an end located opposite the receiving element, wherein each ball joint of the row is circumferentially enclosed by a shingle and the ball-and-socket joint is circumferentially enclosed by an end shingle. Advantageously, the shingles overlap each other at least in portions.

The shingles can be arranged around the ball joints in such a way that the respective ball joints are rotatable or pivotable relative to the shingles. Preferably, the components of the device are rotation-symmetrically formed, so that a pivoting in all directions is enabled. According to an advantageous embodiment, the respective shingles can be configured overlapping at least in portions and can have a rounded or spherical skin surface.

The ball joints connected with each other in a row preferably form a centre of the device, which is circumferentially broadened by the shingles. In a device inserted into a hollow structural component, the shingles can abut on the hollow structural component on the inside in a positive fitting manner.

Here, a vacuity between two shingles each and the hollow structural component can be minimized by an overlap of the shingles in portions, so that the shingles form an extensive contact area to the hollow structural component. By this, the occurrence of material creases or accidental changes in the cross section of the hollow structural component during a bending can be counteracted. Due to the overlap, the mobility and the variances of the ball joints and the shingles chained to each other can be maintained. In particular, the device or the ball joints and shingles that are strung together can be moved and bended in all directions.

Due to the rotation-symmetrical construction of the device, a contortion of the device can be excluded. Further, the device can be adjusted as long or short as desired, depending on a number of ball joints and shingles.

In an advantageous embodiment, the pivot points or rotation points of the ball joints and the shingles surrounding the ball joints are identical.

The device can be used as a retrofit solution as a bending mandrel for already existing bending devices. The tool components for holding and transforming the hollow structural component can still be used.

The respective ball joints and the shingles can preferably be connected with each other in a positive locking manner. The end shingle and the ball-and-socket joint can finish the row of shingles and ball joints at the end and can thus prevent an accidental loosening of the shingles and ball joints. A second end of the row is formed by the receiving element and the mandrel shaft.

The individual components of the device can be made of a metal, a metal alloy, a plastic, a reinforced plastic, ceramics and the like. In particular, the respective components can be made of one or of different materials. For example, the ball joints can be made of a metal and the shingles can be made of a plastic in order to avoid a damaging of sensitive hollow structural components.

In contrast to already known shingle mandrels, due to the overlap of the shingles, no opening gap or vacuity between the shingles is generated by bending the device. Due to the modular construction of the device, the row of shingles and ball joints may be adjusted as long or short as desired.

The device can be particularly precisely bendable if the shingles and the end shingle have a holding section. A ball joint or a ball-and-socket joint can be inserted into the holding section in a positive locking manner and are pivotable in the holding section. Preferably, at least in the region of the holding section, the ball joint and the ball-and-socket joint can have a spherical form on the outside, which corresponds to a form of the holding section. Thus the shingles and the ball joints at the holding section can be configured rotatable and pivotable in a positive-locking manner. In particular, these components can be tilted relative to each other via a rotational axis at the holding section.

According to a further embodiment, the shingles and the end shingle have a limiting section which is configured as a stop for a ball joint or a ball-and-socket joint. Preferably the limiting section can push against a first section of a following or adjacent ball joint during a bending of the device and can thus limit the bending radius of the device. Advantageously, the limiting section can be inserted at the end of the shingle or the end shingle and can be spaced apart from the holding section. A length which is spanned by the holding section and the limiting section can essentially correspond to a length of a ball joint.

Despite a bending of the device, two shingles can maintain an optimal overlap to each other, if the shingles have a guiding section. The guiding section is configured for partially receiving and guiding an adjacent shingle or end shingle. Thus the shingles can be guided to slide past each other during the bending of the device and can always maintain a constant vacuity to the hollow structural component. Additionally, the guiding sections of the shingles can be formed in such a way that the pivot points or rotation points of the shingles correspond to the rotation points of the ball joints.

According to a further embodiment, the holding section is arranged between the limiting section and the guiding section, is formed spherical and has an inner diameter which corresponds to an outer diameter of a first end section of the ball joint. By this, two shingles arranged in a row can be optimally guided and twisted relative to each other.

According to a further embodiment, the limiting section is arranged offset to the holding section and has an inner diameter which corresponds to an outer diameter of a first end section of the ball joint. According to a further embodiment, the guiding section has an inner diameter which corresponds to an outer diameter of a spherical skin surface of the shingle or end shingle. Preferably, the holding section is inserted on the inside into the respective shingle and/or end shingle between the limiting section and the guiding section. The holding section, the limiting section and the guiding section are preferably rotation-symmetrically formed and can correspond to segments of a circle with identical of different radii.

The device can be used particularly efficiently and versatilely if the shingles and/or the ball joints can be rotated and/or pivoted in all directions relative to each other. This action can in particular be realized by the rotation-symmetrical design of the components of the device. In particular, this can avoid an accidental contortion or jamming of the shingles and/or ball joints.

According to a further embodiment, a vacuity can be adjusted between two shingles each, wherein the vacuity is constant, independent of a bending degree of the device. By this, the hollow structural component can always be supported evenly by the device, independent of a bending radius. The constant vacuity can, in particular, be realized by the overlapping of the shingles in the region of the guiding sections as well as by the same rotation points of the shingles and the ball joints.

The shingles and ball joints connected with each other in a row can be attached at the end technically particularly easily, if the receiving element can be connected to the mandrel shaft via a fastening means.

The device can be set to any length without using any tools, if at least one ball joint and/or the receiving element is configured divisible. For example, the ball joints and/or the receiving element can be configured in two parts. By this, the respective ball joints can be connected with each other by splitting up and connecting again. The shingles can encompass the respective ball joints circumferentially and can arrest the multi-part ball joints against loosening again. By this, the shingles can fulfil an additional function as security ring.

The receiving element can also be designed in two parts, depending on the configuration. Preferably, the receiving element can be inserted into an inner section of the mandrel shaft in a positive locking manner, so that the mandrel shaft secures the receiving element against breaking up or splitting. Here, the receiving element can also have an internal thread for enabling a fastening at the mandrel shaft.

According to an alternative or additional embodiment, the ball joints can also be designed in one piece and can be latchingly connectable with each other to form a row. For this, the ball joints can have perforations at least in portions.

According to a further aspect of the invention, a method for bending a hollow structural component is provided, wherein the device according to the invention can be inserted into a vacuity of the hollow structural component in a positive-locking manner.

In one step the hollow structural component is bent together with the used device by an outer application of force. The used device here prevents a deformation of the cross section of the vacuity during the deformation. In addition, the used device can serve as a stop for an admissible or provided bending radius.

Figure 1A:
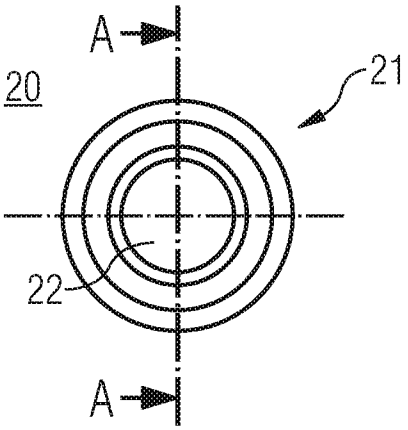
Figure 3B:
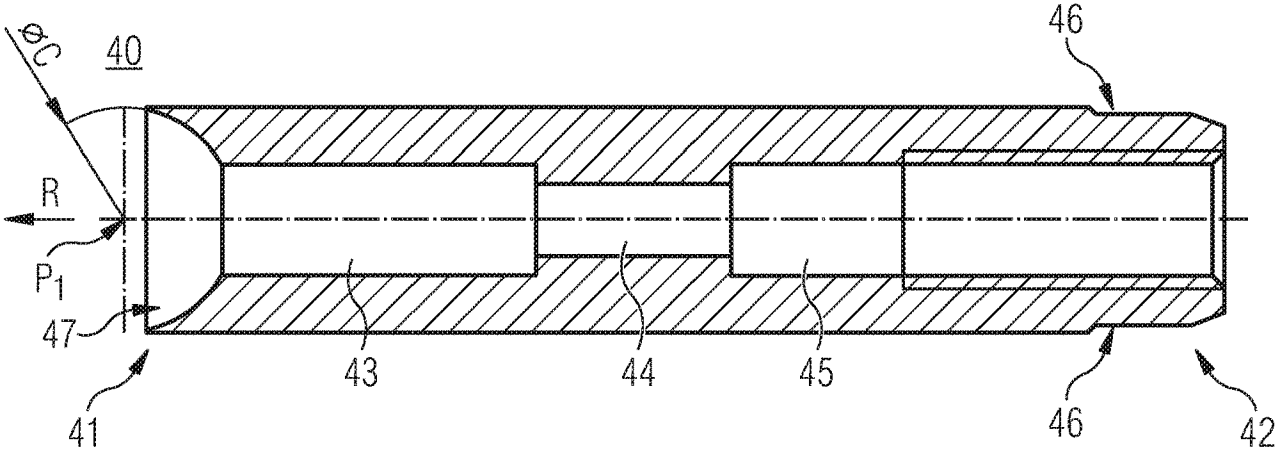
Figure 3A:
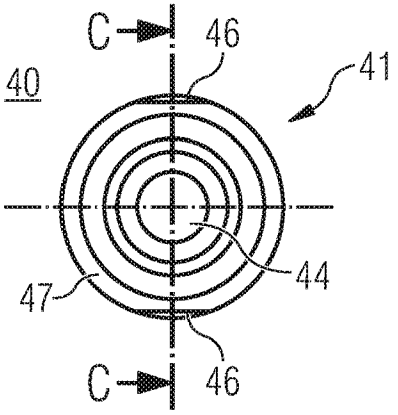
Figure 3C:
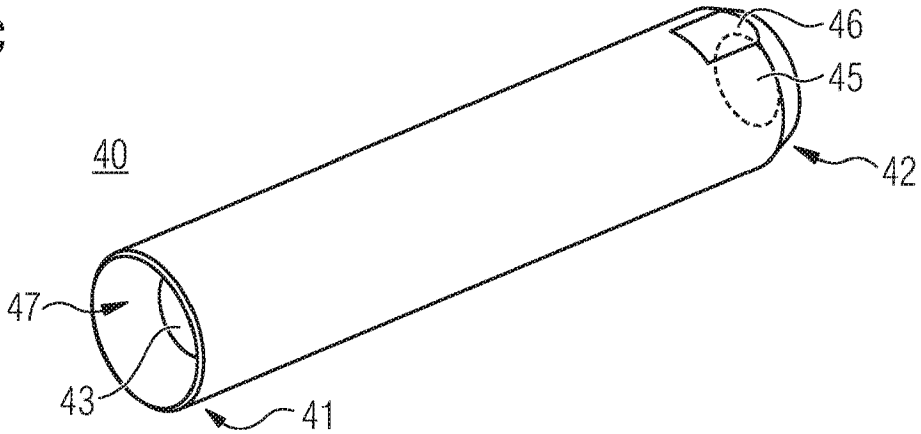
Figure 5B:
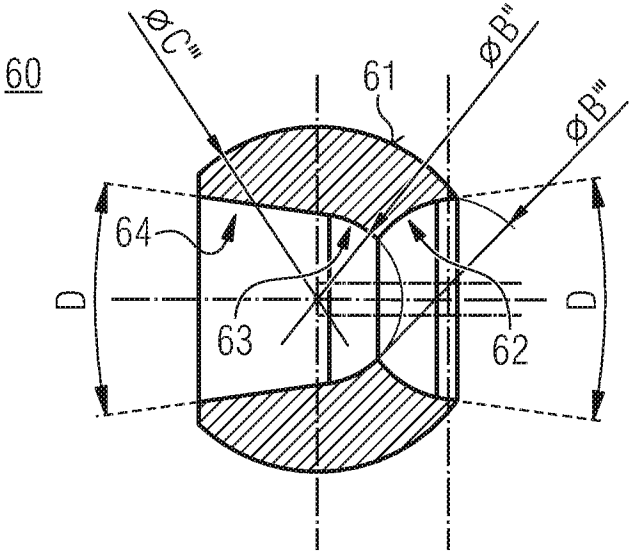
Figure 5A:
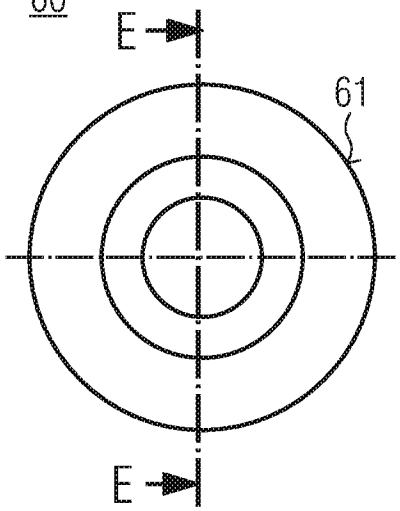
Figure 5C:
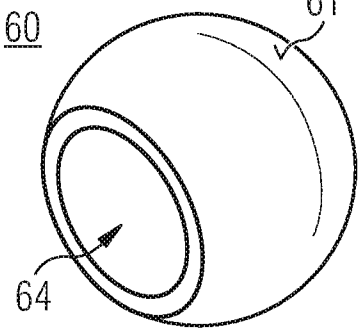
Figure 6B:
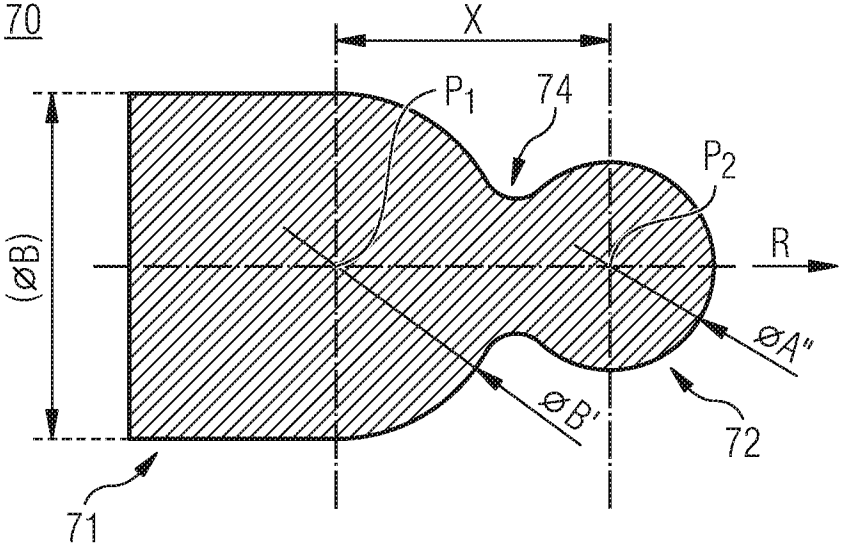
Figure 6A:
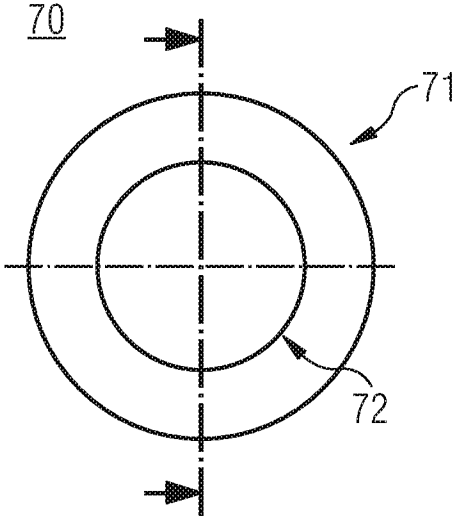
Figure 6C:
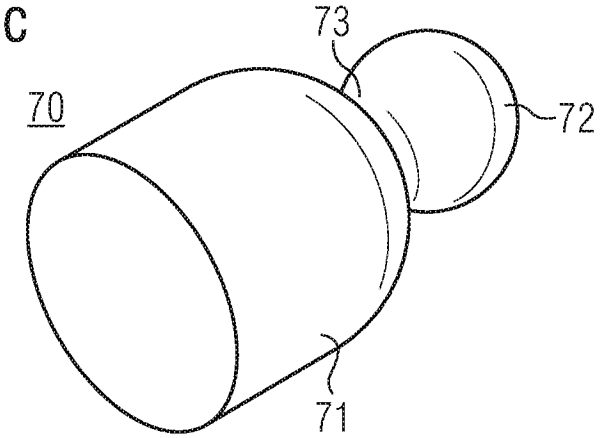
Figure 7:
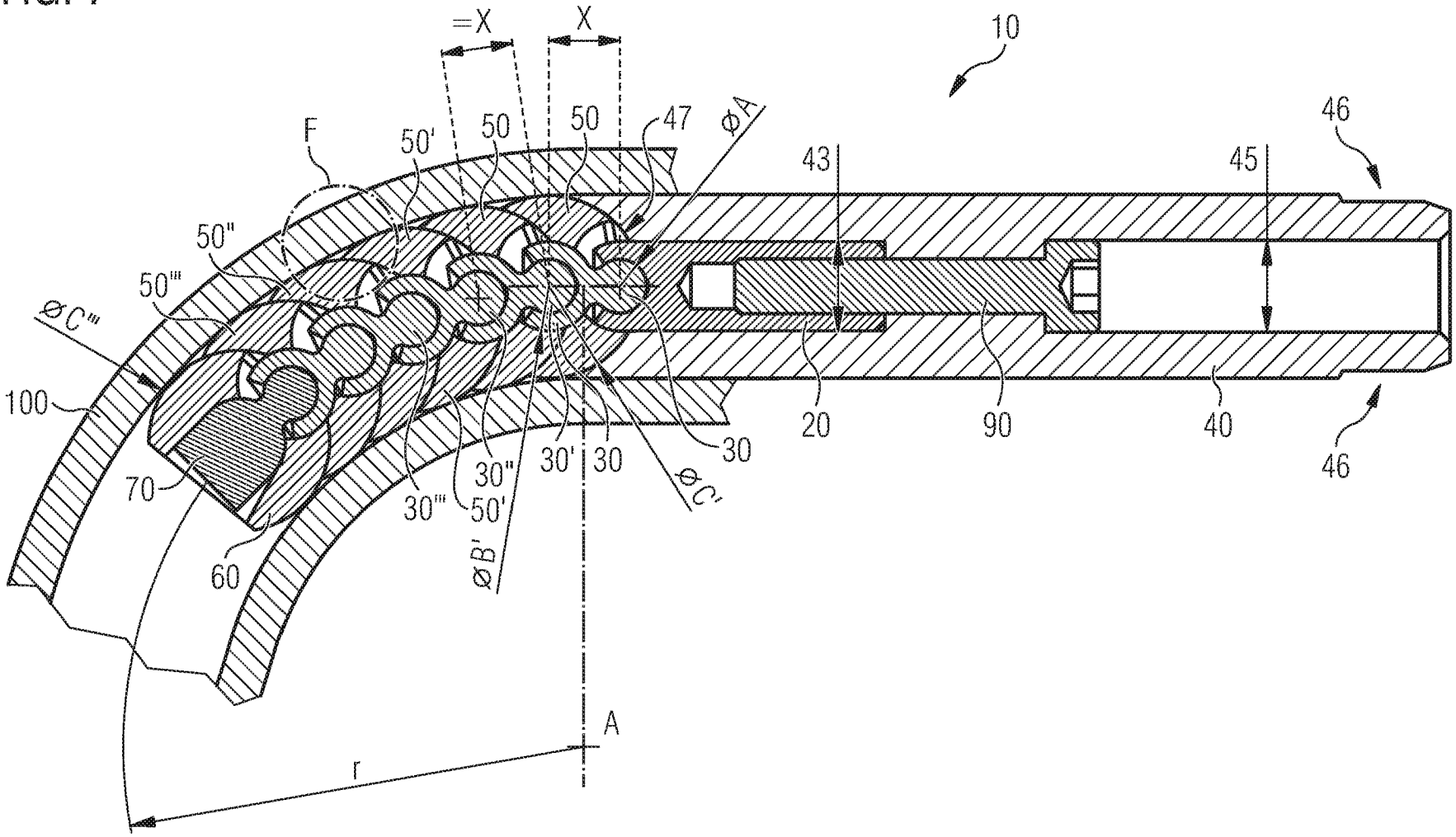
Figure 8:
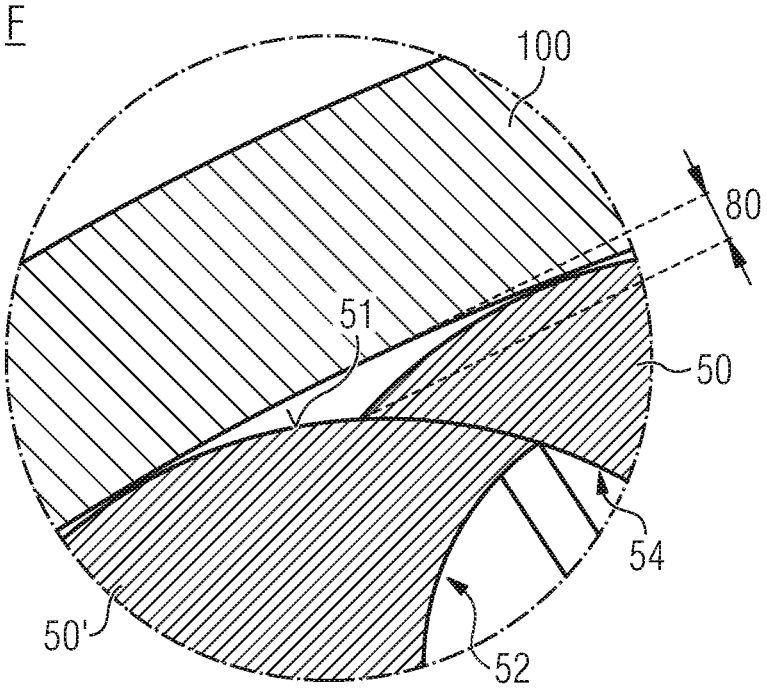

In the following, several embodiments of the invention are explained in more detail by means of the drawings. The figures show the following:

FIGS. 1*a* and 1*b* sectional views of a receiving element of a device according to the invention according to one embodiment, FIGS. 2*a*, 2*b* and 2*c* views of a ball joint of the device according to the invention, FIGS. 3*a*, 3*b* and 3*c* views of a mandrel shaft of the device according to the invention, FIGS. 4*a*, 4*b* and 4*c* views of a shingle of the device according to the invention, FIGS. 5*a*, 5*b* and 5*c* views of an end shingle of the device according to the invention, FIGS. 6*a*, 6*b* and 6*c* views of a ball-and-socket joint of the device according to the invention, FIG. 7 a sectional view of the device according to the invention in a state inserted into a hollow structural component, and FIG. 8 a detailed view F of FIG. 7.

FIG. 1*a* and FIG. 1*b* show sectional views of a receiving element 20 of a device 10 according to the invention according to one embodiment. According to the embodiment, the device 10 is configured as a device 10 for bending hollow structural components 100 and in particular as a joint shingle mandrel.

FIG. 1*b* shows a sectional view along a sectional plane A-A of FIG. 1*a*. The receiving element 20 is formed cylindrical. At a first end 21 the receiving element 20 has a spherical receiving section 22. The receiving section 22 has an opening angle D at the end which can, for example, be between 90° and 170°.

The receiving section 22 has an inner diameter A and an outer diameter B. The receiving section 22 can be configured flexible or bendable at the end. According to an additional or alternative embodiment, the receiving element can be split into at least two parts for opening the receiving section 22.

At a second end 23 positioned opposite the first end 21 a borehole with an internal thread 24 is inserted into the receiving element 20. Preferably, the receiving element 20 is formed rotation-symmetrical along a rotational axis R.

FIG. 2*a*, FIG. 2*b* and FIG. 2*c* show views of a ball joint 30 of the device 10 according to the invention. The ball joint 30 has a first end section 31 and a second end section 32. The first end section 31 is formed corresponding to the receiving section 22 of the receiving element 20 and forms an inner spherical receiving space 33. The receiving space 33 is opened at the end with the opening angle D'. According to the embodiment, the opening angle D of the receiving element 20 and the opening angle D' of the ball joint 30 are identical. In addition, in the first end section 31, the ball joint 30 has an inner diameter A', which is similar to the inner diameter of the receiving section 22 of the receiving element 20. An outer diameter B' of the first end section 31 is also similar to an outer diameter B of the receiving section 22.

The second end section 32 of the ball joint 30 is essentially configured spherical and extends in the direction of the rotational axis R from the first end section 31. Here, the ball joint 30 is configured rotation-symmetrical along the rotational axis R. The first end section 31 is spaced apart from the second end section 32 via a ligament 34.

The first receiving section respectively the first end section 31 of the ball joint 30 has an inner diameter A', which also corresponds to an outer diameter A" of the second end section 32. By this, a ball joint 30 can be inserted with the second end section 32 into the first end section 31 of an adjacent ball joint 30'.

Here, the second end section 32 can be arranged in the receiving space 33 of the first end section 31 and thus can be connected pivotably as well as rotatably. Due to such a sequence of ball joints 30, a row of ball joints 30 can be produced.

Here, the first end section 31 forms a first rotation point P1 and the second end section 32 forms a second rotation point P2. If two ball joints 30, 30' are connected with each other, the rotation points P1, P2 overlap each other preferably congruently. Depending on the embodiment, the ligament 34 can be adapted at a length so that a distance X between the rotation points P1, P2 can be adjusted.

The rotation points P1, P2 are configured in such a way that a translational movement is prevented, whereas all rotational variances in the frame of the opening angles D, D' are maintained. By this, a pivoting in all directions and rotation along the rotational axis R of at least two ball joints 30, 30' arranged in a row can be realized.

According to the shown embodiment, the ball joint 30 is configured in two parts. In particular, the ball joint 30 can be divided along a sectional plane B-B from FIG. 2*a*. Due to this division of the ball joint 30, the receiving space 33 can be released, so that a second end section 32 can be inserted into the receiving space 33 in a positive fitting manner. In FIG. 2*c* a perspective view of the ball joint 30 is shown, which illustrates the sectional plane B-B.

FIG. 3*a*, FIG. 3*b* and FIG. 3*c* show pictures of a mandrel shaft 40 of the device 10 according to the invention. FIG. 3*b* illustrates a sectional view along a sectional plane C-C from FIG. 3*a*. FIG. 3*c* shows a perspective view of the mandrel shaft 40.

The mandrel shaft 40 is essentially formed rotation-symmetrical along the rotational axis R and has a first end 41 and a second end 42. At the first end 41 of the mandrel shaft 40 a receiving space 43 for the receiving element 20 is provided. In particular, the receiving element 20 can be positioned in the receiving space 43 in such a way that merely the first end 21 of the receiving element 20 projects from the receiving space 43 at the end.

The receiving space 43 of the mandrel shaft 40 is connected with an end borehole 45 via a connecting borehole 44 in the direction of the second end 42. The end borehole 45 is configured larger than the connecting borehole 44. The receiving element 20 can be screwed to the mandrel shaft 40 through the end borehole 45 and the connecting borehole 44.

For a fastening of the mandrel shaft 40 on the tool side spanner flats 46 for tightening/fitting onto a conventionally built mandrel bar are arranged at the second end 42, which prevents a contortion of the mandrel shaft 40.

At the first end 41 of the mandrel shaft 40 a spherical broadening 47 of the receiving space 43 is provided. The broadening 47 has an inner diameter C.

FIG. 4*a*, FIG. 4*b* and FIG. 4*c* shows pictures of a shingle 50 of the device 10 according to the invention. FIG. 4*b* shows a section along the sectional plane D-D from FIG. 4*a*.

The shingle 50 has a spherical skin surface 51 with an outer diameter C'. The outer diameter C' of the skin surface 51 here preferably corresponds to the inner diameter C of the broadening 47 of the mandrel shaft 40. By this, a shingle 50 can be inserted into the broadening 47 of the mandrel shaft 40 at the end and can be stationarily fastened to the mandrel shaft by means of a ball joint 30 via the receiving element 20

The shingle 50 has a limiting section 52, a holding section 53 and a guiding section 54, which form a cavity at the inside, which extends through the shingle 50. The limiting section 52 here passes into the holding section 53 and afterwards into the guiding section 54 in the direction of the rotational axis R.

A ball joint 30 can be inserted into the holding section 53 with the second end section 32 via the guiding section 54 in such a way that the outer diameter B' of the first end section 31 can nestle to an inner diameter B" of the holding section 53 in a positive locking manner. By this, the shingle 50 and the ball joint 30 can form a mutual rotation point P1. The shingle 50 and the ball joint 30 can thus be pivoted and rotated relative to each other along the rotation point P1.

The limiting section 52 is also configured spherical and has an inner diameter B'", which corresponds to an outer diameter B' of the first end section 31 of the ball joint 30. By this, the limiting section 52 can serve as a lateral end stop for a row of ball joints 30. A maximum relative pivoting angle b between the ball joint 30 and the shingle 50 can thus be defined by the form and the size of the limiting section 52.

The guiding section 54 is spherically shaped and has an inner diameter C" which corresponds to an outer diameter C' of the skin surface 51 of the shingle 50. By this, several shingles 50 can be arranged in a row and can overlap in regions due to the guiding section 54. Due to the guiding section 54, the rotation point P1 is also defined for a shingle 50' arranged in the guiding section 54.

FIG. 5*a*, FIG. 5*b* and FIG. 5*c* show pictures of an end shingle 60 of the device 10 according to the invention. The end shingle 60 essentially corresponds to the shingle 50. In contrast to the shingle 50, the end shingle 60 has no guiding section 54, but it passes into a conical receiving section 64 at the end. Here, FIG. 5*b* shows the sectional plane E-E from FIG. 5*a*, which illustrates the form of the receiving section 64.

The end shingle 60 also has a spherical skin surface 61, which has a same outer diameter Ca. The outer diameter C'" of the end shingle 60 corresponds to an outer diameter C' of the skin surface 51 of the shingle 50.

Further, the end shingle 60 has a holding section 63 and a limiting section 62, which, according to the embodiment, are formed identical to the shingle 50.

The end shingle 60 serves for terminating a row of shingles 50, 50' at the end. Thus, a row of shingles 50, 50' can be clamped between the spherical broadening 47 of the mandrel shaft 40 and the end shingle 60. Here, the end shingle 60 can project into the guiding section 54 of a shingle 50, wherein a ball- and socket joint 70 can be inserted into the receiving section 64 of the end shingle 60 and stationarily fastens the end shingle 60 at a ball joint 30. Such a ball-and-socket joint 70 is illustrated in FIG. 6*a*, FIG. 6*b* and FIG. 6*c*.

The ball-and-socket joint 70 has a ligament 74 and a second end section 72, which resemble the ball joint 30 in form and dimensions. In contrast to the ball joint 30, the ball-and-socket joint 70 has a first end section 71, which is formed cylindrical. By this, the first end section 71 of the ball-and-socket joint 70 can interact with the receiving section 64 of the end shingle 60 in a positive locking manner and can fasten the end shingle 60.

FIG. 7 shows a sectional view of the device 10 according to the invention in a state inserted into a hollow structural component 100. The hollow structural component 100 is already bent, so that an interaction of the components 20, 30, 40, 50, 60, 70 of the device 10 is illustrated. According to the embodiment, the hollow structural component 100 is configured as a tube.

The device 10 consists of a receiving element 20, which is connected to the mandrel shaft 40 by means of a screw 90. Here, the receiving element 20 is arranged in the receiving space 43 of the mandrel shaft 40. The receiving element 20 projects from the mandrel shaft 40 at the end in such a way that a shingle 50 can fit into the spherical broadening 47 in a positive locking manner. By this, the spherical broadening 47 can serve as a guiding section on the mandrel side. A ball joint 30 arranged in the receiving section 22 of the receiving element 20 fastens the shingle 50 at the receiving element 20 and the mandrel shaft 40.

The ball joints 30, 30', 30", 30'" are arranged in a row and are rotatably and pivotably connected to each other. Here, the respective second end sections 32 are inserted into the first end sections 31 of the adjacent ball joints 30, 30', 30", 30'". Around the ball joints 30, 30', 30", 30'" shingles 50', 50", 50'" are circumferentially arranged, wherein, in the region of the holding sections 53, the shingles 50 touch the respective first end sections 31 of the ball joints 30 on the inside in a positive locking manner. The respective ball joints 30 fasten the shingles 50 in the respective guiding sections 54 and thus enable an overlap of the shingles 50. Such an overlap is illustrated in FIG. 8, which shows a detailed view F of FIG. 7. Here, due to the overlap, a vacuity 80 between two shingles 50, 50' and the hollow structural component 100 is formed, which is minimized in its volume.

Further, FIG. 7 schematically shows the respective rotation points P1, P2 and the distances X between the rotation points P1, P2. Each ball joint 30 shares the rotation point P1 in the region of the first end section 31 with a shingle 50. Here, the rotation points P1 and P2 of two adjacent ball joints 30, 30' are congruent and overlap each other.

For illustration of the mode of operation of the limiting sections 52, a minimal bending radius r of the device 10 is set around a bending axis BA.

LIST OF REFERENCE SIGNS

100 hollow structural component
10 device/joint shingle mandrel
20 receiving element
21 first end of the receiving element
22 receiving section of the receiving element
23 second end of the receiving element
24 internal thread
30 ball joint/first ball joint
30',30",30'" adjacent ball joints
31 first end section/first receiving section
32 second end section
33 receiving space of the first end section
34 ligament
40 mandrel shaft
41 first end of the mandrel shaft
42 second end of the mandrel shaft
43 receiving space for receiving the receiving element
44 connecting borehole
45 end borehole
46 spanner flat
47 spherical broadening
50 shingle
50',50",50'" adjacent shingles
51 skin surface
52 limiting section
53 holding section
54 guiding section
60 end shingle
61 skin surface of the end shingle
62 limiting section
63 holding section
64 receiving section of the end shingle
70 ball-and-socket joint
71 first end section of the ball-and-socket joint
72 second end section of the ball-and-socket joint
73 ligament of the ball-and-socket joint
80 vacuity
90 screw/screw connection
A inner diameter of the receiving section 22
A' inner diameter of the first end section 31
A" outer diameter of the second end section 32
b pivoting angle
B outer diameter of the receiving section 22
B' outer diameter of the first end section 31
B" inner diameter of the holding section 53
B'" inner diameter of the limiting section 52
BA bending axis of the device
C inner diameter of the broadening 47 of the mandrel shaft 40
C' outer diameter of the skin surface 51
C" inner diameter of the guiding section 54
C'" outer diameter of the end shingle 60
D opening angle of the receiving section 22
D' opening angle of the receiving space 33
P1 first rotation point
P2 second rotation point
r minimum bending radius
X distance between two rotation points

The invention claimed is:

1. A device (10) for bending hollow structural components (100), comprising a receiving element (20);

a mandrel shaft (40) for receiving the receiving element (20), at least two ball joints (30, 30') forming a row of at least two ball joints (30, 30') wherein the ball joints (30, 30') of the row of at least two ball joints (30, 30') are connected with each other and the row of at least two ball joints (30, 30') is inserted into the receiving element (20) at a first end of the row of at least two ball joints (30, 30'), a ball-and-socket joint (70), wherein the row of ball joints (30, 30') is lockable by the ball-and-socket joint (70) at a second end of the row of at least two ball joints (30, 30') located opposite the receiving element (20), at least two shingles (50, 50'), wherein each ball joint (30, 30') of the row of ball joints (30, 30') is circumferentially enclosed by one of the at least two shingles (50, 50'), and wherein one of the at least two shingles (50, 50') and/or one of the ball joints (30, 30') is rotatable and/or pivotable in all directions relative to each other, and an end shingle (60), wherein the ball-and-socket joint (70) is circumferentially enclosed by the end shingle (60), and one of the at least two shingles (50, 50') and the end shingle (60) overlap each other at least in portions characterized in that one of the at least two shingles (50, 50') and the end shingle (60) comprise a holding section (53, 63), wherein one of the ball joints (30, 30') and the ball-and-socket joint (70) are insertable into the holding section (53, 63) in a positive locking manner and are pivotable in the holding section (53, 63).

2. The device according to claim 1, wherein one of the at least two shingles (50, 50') and the end shingle (60) have a limiting section (52, 62) which is configured as a stop for one of the ball joints (30, 30') or the ball-and-socket joint (70).

3. The device according to claim 1, wherein one of the at least two shingles (50, 50') have a guiding section (54), wherein the guiding section (54) is configured for partially receiving and guiding an adjacent shingle (50', 50", 50'") or end shingle (60).

4. The device according to claim 1, wherein one of the at least two shingles (50, 50') and the end shingle (60) have a limiting section (52, 62) which is configured as a stop for the ball joints (30, 30') or the ball-and-socket joint (70);

wherein one of the at least two shingles (50, 50') have a guiding section (54), wherein the guiding section (54) is configured for partially receiving and guiding an adjacent shingle (50', 50", 50'") or end shingle (60); and wherein the holding section (53) is arranged between the limiting section (52) and the guiding section (54), and the holding section (53) comprises a spherical form with an inner diameter (B") which corresponds to an outer diameter (B') of a first end section (31) of one of the ball joints (30, 30').

5. The device according to claim 4, wherein the limiting section (52) is arranged offset to the holding section (53) and wherein the limiting section (52) has an inner diameter (B'") which corresponds to an outer diameter (B') of the first end section (31) of one of the ball joints (30, 30'), wherein the guiding section (54) has an inner diameter (C") which corresponds to an outer diameter (C') of a spherical skin surface (51) of one of the at least two shingles (50, 50') or end shingle (60).

6. The device according to claim 1, wherein a vacuity (80) is formed between each two shingles (50, 50'), wherein the vacuity (80) remains a constant volume, independent of a bending degree of the device (10).

7. The device according to claim 1, wherein the receiving element (20) is connectable to the mandrel shaft (40) via a fastening means (90).

8. The device according to claim 1, wherein at least one of the ball joints (30, 30') and/or the receiving element (20) is configured divisible.

* * * * *